United States Patent [19]

Banahan

[11] Patent Number: 4,852,656

[45] Date of Patent: Aug. 1, 1989

[54] FIRE EXTINGUISHING APPARATUS

[76] Inventor: Robert J. Banahan, 3249 N. Alcott Ave., Chicago, Ill. 60634

[21] Appl. No.: 115,417

[22] Filed: Nov. 2, 1987

[51] Int. Cl.[4] ..... A62C 1/08; A62C 27/24

[52] U.S. Cl. ..... 169/91; 169/47

[58] Field of Search ..... 169/43, 1, 50, 91, 62, 169/70; 406/39, 43; 37/80 R, 91, 94; 98; 172/67, 70

[56] References Cited

U.S. PATENT DOCUMENTS

| | | | |
|---|---|---|---|
| 949,341 | 2/1910 | West | 37/94 |
| 2,561,701 | 7/1951 | Hurlbert | 169/91 |
| 2,949,158 | 8/1960 | Lowry | 169/91 |

FOREIGN PATENT DOCUMENTS

| | | | |
|---|---|---|---|
| 2568779 | 2/1986 | France | 169/47 |

*Primary Examiner*—Joseph F. Peters, Jr.
*Assistant Examiner*—Edwin L. Swinehart
*Attorney, Agent, or Firm*—John J. Kowalik

[57] ABSTRACT

An ambulatory fire fighting apparatus comprising at its front end a device for lifting the overburden and comminuting and exposing the nonflammable soil which passes unded a rotary drum which pulverizes the soil and discharges the pellets of dirt through a guide chute, the chute being associated with a fan which has branches for directing of air entraining the pellets and pressurizing the drum.

19 Claims, 1 Drawing Sheet

FIRE EXTINGUISHING APPARATUS

BACKGROUND OF THE INVENTION

This invention pertains to an ambulatoryor self propelled fire fighting apparatus for use in forest, praire or similar fires in remote areas where no water is available or where the use of water would promote toxic fumes which would be caused by any fire retardant chemicals previously applied to the site or would spread the toxic and hazardous material into the environment.

The invention is directed to the utilization of in situ non-flammable material such as primary soil and casting such material onto the fire to thus cut off oxygen and smother the blaze.

BACKGROUND OF THE INVENTION

The prior art teaches the use of shovels and the like to dig into the soil and fling it into the fire. This poses great risk for the fire fighter and the small quantity of soil moved by a shovel is usually not adequate. Presumably bull dozers and the like may be used to bury the fire. However, this requires large equipment which normally cannot be transported to an inaccessible fire site and their effectiveness is thus limited to accesible areas. Some attempts have been heretofore to haul nonflammable material by wagons and dumping it onto the fire. This requires time consuming hauling and the use of this method, as presently known to me has been abandoned.

SUMMARY OF THE INVENTION

This invention is directed to a novel portable apparatus which digs into the terrain for non-burnable material and which then cast or slings the material through a directing chute onto the blaze in sufficient quantities to smother it.

One object of the invention is to provide a manueverable fire fighting apparatus which may be pushed to the fire or is self propelled and easily guided by an individual fire fighter.

Another object is to provide the unit with a rotary drum with a floating guard in back to protect the operator from flying rocks and lumps of dirt and the like.

A further object is to provide a device which scarfs any top growth from in front of the machine which is provided with comminuting mechanism for breaking up the subsoil in front of an oncoming pitching and comminuting drum which throws the subsoil particulate through a directing chute onto a fire.

Another object is to provide such apparatus with a drum having novel resilient blades or tines operative to scoop the soil with spoon shaped end portions provided on the ends of the tines, said tines being deflectible circumferentially of the drum and springing back during digging and in addition to the centrifugal moments developed by high speed rotation of the drum also imparting the spring return component for flinging the particles of soil into a discharge chute with sufficient trajectory to deposit such particles onto the fire.

Another object is to provide a supplementary forced air source which augments the moments imparted by the other components in cascading the particles from the chute onto the fire.

As till further object is to provide an auxilliary blower which has a duct leading into the drum air inlet to prevent a vacuum or low pressure area forming in front of the drum and which provides a pressure head at the air inlet into the drum so as to maximize the effectiveness of the drum in discharging the non-flammable soil through the discharge chute.

Another object is to provide a drum with dirt-cutting and and comminuting means comprising circular laterally spaced edged blades for breaking up the soil and serving as rock guards, the blades flanking the drum tines which are rotated at high speed and whip through the soil particles and cast them onto a fire through a discharge tube.

The invention contemplates the provision of a novel blower having one air discharge branch directed to augment the discharge of partices from the chute and another branch directed into the drum to maximize the air supply to the drum.

The invention is also directed to a novel fire fighting apparatus wherein the components are arranged to enhance the effectiveness of each other but also wherein they are positioned in front of the operator between him and the fire to serve as a shield.

Another object is to provide a novel particle-propelling drum which comprises a casing carried on a center shaft, the shaft driving a pair of axially spaced cutter disks which are positioned adjacent to respective side walls of the of the drum casing, the disks confining a group of radially extending spring fingers or tines which flex circumferentially upon striking the ground and which generate a circumferential and radial flow of air directed toward the ground and then tangentially with the entrained particles into a discharge chute.

These and other object and advantages inherent in and encompassed by the invention will become more apparent from the specification and the accompanying drawing, wherein.

DESCRIPTION OF THE INVENTION

Figures 1, 2, 3, 4:
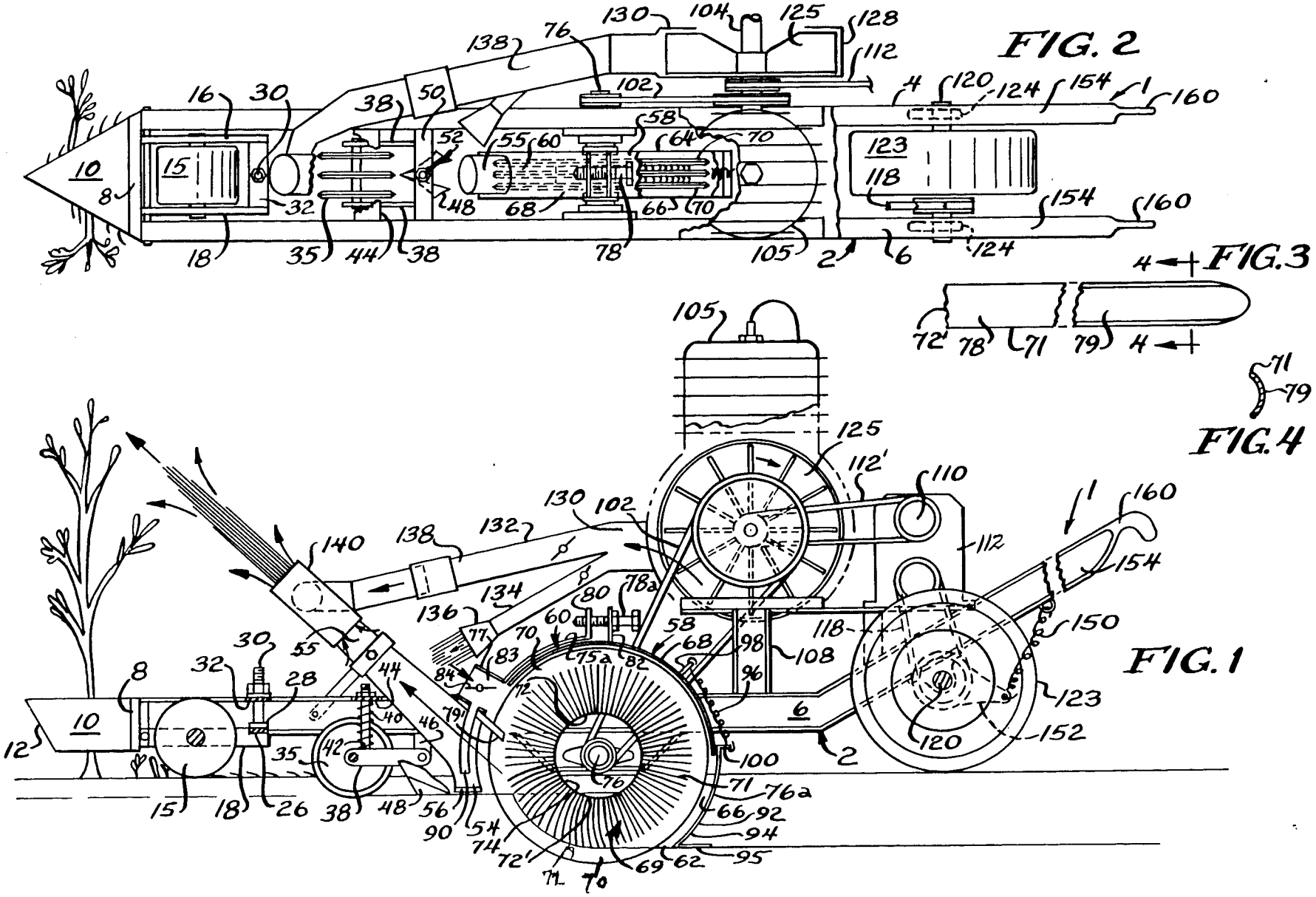
FIG. 1 is a side elevational view with parts shown in section taken substantially on line 1—1 of FIG. 2.
FIG. 2 is a top plan view with part broken away and shown in section of the equipment taken substaially on line 2—2 of FIG. 1.
FIG. 3 is a front view of an end portion of one of the drum tines.
FIG. 4 is a cross section of one of the tines.

The fire fighting apparatus shown in the drawings is identified generally by the numeral 1 and comprises and ambulatory self-propelled frame 2 including a pair of longitudinal side frames or beams 4 and 6 which are interconnected at their forward or front ends by a transverse beam member 8.

The beam member 8 supports a divider 10 shown in top plan view as triangular in shape which has a downwardly and rearwardly sloping front edge 12 and is effective to spread the bramble or other growth such as weeds etc. apart to facilitate passage of the equipment over the terrain.

The rear base portion of the divider is mounted to the front side of the front beam member.

Behind the transverse front beam member there is provided a front support roller 15 which is journaled between a pair of fore and aft extending arms on an axle secured to the arms intermediate their front and rear ends. The arms 16,18 are pivoted at their front ends on a pin from the lower ends of brackets supported on beams 4 and 6. The pin is horizontal and provides an axis of pivot transverse to the direction of transverse of the unit. The rear ends of the arms are interconnected by a transverse bar 26 which serves as an up stop abuttment against a stop end 28 of an adjustable stop bolt 30 which extends through an opening in a support element 32 and is threaded through a nut welded to element 32. Thus the front roller may drop to ride through a depression but as soon as it reaches level or higher ground it will move upwardly and engage with the stop thus lifting or supporting the front end of the unit.

Behind the front guide roller, there are mounted a series of steel disk plows or cutters 35 which comprise a transverse shaft rotatably journalled at the ends on the forward ends of a pair of side links 38,38 each of which is biased downwardly by a compression spring 40 which at its lower end bears against the top edge of the associated link 38 as at 42 and at its upper end reacts against the bottom side of a transverse beam member 44 connected at its ends to the side rails of the main frame. The rear ends of the links 38 are each privoted on a horizontal transverse axis to pendant ears 46 depending from respective side rails. The disk plows are edge sharp and cut through the soil or sod etc. and slice the soil therebeneath. The disk plows may be positioned slightly askew to the direction of travel to compound their action in scarfing and cutting and plowing the overburden.

Behind the disk plow there is positioned a share plow 48 which is secured at its top to a transverse main bar frame 50 as by a securing bolt 52. The share plow parts the sod or plant growth overburden laterally and exposes the underlayer of earth or aggregate which extends rearwardly to a region beneath the lower portion of the inlet structure 54 of an upwardly and forwardly inclined discharge chute 55. The lower portion of the inlet end of the chute is provided with a droop lip 56 formed of elastomeric material laced with fiber such as a tire carcass. The lip guides any soil particles discharged thereagainst into the chute and is yieldable to prevent damage as it traverses the terrain.

A cutting and pulverizing drum 58 follows the share plow and digs at a level therebelow. The drum comprises a generally cylindrical housing or casing 60 made of sheet metal with an open bottom 62 and having laterally spaced side walls 64,66 and a circumferential arcuate segmented wall 68 extending between and interconnecting the side walls 64,66.

The wall 68 is an arcuate sector contoured about a beater 69 which has a pair of laterally or axially spaced side disks 70,70 which sharp periperal edges 72. The disks or cutters 70,70 flank a plurality of radially extending resilient combination beaters, soil scarfers and comminuters and impellers arranged in brush-like fashion. The impellers 71 may be flat bars of spring steel and are secured at their root ends 72' to the periphery of a core 74 which is fixed to a center drive shaft 76. The impellers may be flat bars as shown or may have cylindrical stem portions 78 and outer end transversely arcuated spoon shaped portions 79 to better scoop up up the agregate. The impellers will bend back when digging into and scrape into the exposed virgin soil and will spring back to unloaded position when exiting the ground and thus mechanically and centrifugally sling the material through the duct as abetted by the blast of air generated by the drum.

As seen in FIG. 1 the duct 55 flares reawardly and immediately above the duct is a cut-off plate 79' mounted on the duct and extending into the drum housing in scraping relation to the outer ends of the impeller blades to prevent recirculation of the aggregate. It will be noted that the circumferential wall 68 of the housing is provided with extender sections **75*a* and 76*a*. The front section or shroud 75*a* operates to move the air inlet valve assembly 77 to which it is attached clockwise together with the positioning of the inlet end portion of the discharge chute. The adjustment is accomplished by bolt 78*a* threaded through a lug 80 on the shroud 75*a* and a stationary lug 82** on the stationary circumferential wall of the blower drum.

The stub inlet tube 83 of air assembly 77 is provided with a damper valve 84 for regulating the amount of air being drawn into the the drum and the tube 83 has a branch pipe 90 which extends proximate to the bottom portion of the inlet section of the discharge tube for aspirating any dust generated about or in front of the drum.

The arcuate rear section **76*a* slides upon wall 68 and is interlocked therewith. The lower end portion 92 of the rear section is formed as a forwardly pointed shoe 94 with a ground engaging sole plate 95**.

The section **76*a* is biased toward the earth by gravitation and in order to cause it to float lightly over any ground obstruction such as a protruding stone or the like a tension spring 96 is provided hooked between lugs 98 and 100 at the section 68 and 78*a***.

The drum is driven by a cog belt and pulley assembly or sprocket and chain drive 102 extending between shaft 76 and an output shaft 104 of an internal combustion engine 105 mounted on a pedestal 108 integrally supported on the main frame.

The shaft 104 also drives an input shaft 110 of a transmission 112 by a cog belt and pulley assembly or sprocket and chain drive 118 to a drive axel 120 of a rear roller or wheel assembly 123 disposed between the side beams of the main frame, the axle being set in bearings 124.

The shaft 104 also drives a fan 125 mounted in housing 128 suitably supported on the main frame. The housing has an air discharge opening 130 which communicates with an inlet duct 132 comprised of telescoping sections.

The main air duct 132 has a branch duct 134 connected thereto and the branch duct 134 has a flared outlet 136 in the vicinity of the inlet tube 83 and provides a high pressure zone or head eliminating a vacuum pocket in this region pumping air into the tube 83 to augment the blower action of the aggregate drum.

The main trunk 138 of the duct 134 is angled toward the aggregate discharge tube and connects with a sleeve 140 which is telescoped over the discharge end of the chute or tube 55 and exhausts upwardly and outwardly toward the fire and entrains the aggregate therein to obtain sufficient velocity thereto in a trajectory into the fire.

The unit is counterbalanced across the axle of the rear roller or wheels by tension springs 150 connected to arm 152 and the rear extensions 154 of the frame members 6 and 8. The extensions 154 terminate as handles 160 by which the operator guides and maneuvers the unit.

I claim:

1. An aggregate throwing device for use in fire fighting movable over supporting terrain comprising a housing having a pair of sidewalls and an arcuate intervening wall and having an open bottom and discharge opening through said arcuate wall, a rotary brush-type drum mounted within the housing for rotation about a generally horizontal axis and projecting through said open bottom, and operative to dig into and comminute the soil therebeneath and discharge the same through the discharge opening and, said drum comprising a plurality of flexible digital members adapted to spring back attendant to digging into the soil and to spring forward upon withdrawal from the soil for flinging the soil through said discharge opening, and said members having spoon-shaped ends for cupping the soil therein while digging the soil.

2. Fire fighting apparatus having means for removing overburden including weeds and soil and the like from an an area adjacent to burning terrain to expose nonflammable soil therebeneath, means for comminuting said soil into discrete particles and said apparatus having means including a guide chute for directing particles onto the burning areas, and said comminuting means comprising a disk plow at the leading end of the apparatus for cutting the overburden, and a share plow behind the disk plow for folding the overburden laterally for exposing the nonflammable soil.

3. A field traversing fire fighting apparatus movable in a predetermined direction toward a fire, said apparatus having means for removing overburden including weeds and sod and the like from an area adjacent to burning terrain to expose nonflammable soil therebeneath, means including several different independent components spaced longitudinally from each other in the direction of travel of said apparatus in transferring relation to each other for serially comminuting said soil into discrete particles, and said apparatus having means including a guide chute for directing said particles in a trajectory onto the burning area, one of said components comprising a drum comprising a pair of laterally spaced peripherally sharpened disks and a plurality of radial earth digging and cutting tines confined between said pair of disks and operative to scarf into particles between said disks the soil and comminute it and propell said particles through said chute, said drum having a soil-engaging front side and means for rotating the drum with its soil engaging side sweeping upwardly on its front side, and means for adjusting said chute into alignment with the trajectory of said particles from the drum and a discharge chute positioned in front of said front side of the drum for receiving said particles directly therefrom.

4. Fire fighting apparatus having means for removing overburden including weeds and sod and the like from an area adjacent to burning terrain to expose nonflammable soil therebeneath, means for comminuting said soil into discrete particles, and said apparatus having means including a guide chute for directing particles onto the burning areas, and said apparatus having a drum comprising a pair of laterally spaced peripherally sharpened disks and a plurality of radial earth digging and cutting tines confined between said pair of disks and operative to scarf the soil and propell it through said chute, and said tines each comprising a spoon-like outer end adapted to scoop the soil and to centrifugally cast the soil cupped thereby through said chute.

5. The invention according to claim 4 and auxilliary means operative to augment the movement of said particles through said chute to cast said particles a sufficient distance and in a trajectory directed into the fire.

6. The invention according to claim 5 and said auxilliary means comprising a blower having a conduit with an exhaust connected to said chute and operative to entrain said particles in a high velocity current of air and propell the particles at sufficient velocity to reach the fire.

7. A unit for fighting forest fires and the like comprising ground traversing apparatus movable in a direction toward the fire, means for stripping the terrain in an area adjacent to the fire to expose noninflammable soil, means for comminuting the exposed soil, and means for directing such noninflammable comminuted soil onto the burning terrain, and including a rotary drum positioned behind said directing means and having soil scraping means for reducing the soil into slingable pellets, and said drum having means for confining the scraped soil to prevent lateral dispersement of the pellets and maintaining sufficient volume thereof for maximizing discharge of the pellets through said directing means, said drum being positioned to advance into the soil thereahead in said direction of movement of the apparatus and rotating in a direction to lift the soil into said directing means.

8. The invention according to claim 7 and said confining means comprising a pair of cutting disks flanking said soil scraping means and extending radially therebelow.

9. A unit for fighting forest fires and the like comprising ground traversing apparatus, means for stripping the terrain in an area adjacent to the fire to expose noninflammable soil, means for comminuting the exposed soil, and means for directing such noninflammable soil onto the burning terrain, and including a rotary drum having soil scraping means for reducing the soil into slingable pellets, and said drum having means for confining the scraped soil to prevent lateral dispersement of the pellets and maintaining sufficient volume thereof for maximizing discharge of the pellets through said directing means, and said drum having a housing comprising a pair of side plates and an interconnecting peripheral wall, and said peripheral wall having a vertically movable trailing portion comprising a lower end with a ground-engaging shoe adapted to ride over the terrain.

10. The invention according to claim 9 and said directing means comprising a chute adjustable about the periphery of the drum for alignment with the trajectory of the pellets discharged by the drum.

11. The invention according to claim 9 and means for imparting a secondary velocity to the pellets.

12. The invention according to claim 11 and said imparting means comprising a blower having a discharge duct directing a stream of air paralleling the trajectory of pellets issuing from said directing means.

13. The invention according to claim 9 comprising a main frame having supporting wheels and an engine mounted on the frame for driving said rotary drum and propelling said unit through said wheels over the terrain and thereby operating said stripping means.

14. An aggregate throwing device for use in fire fighting movable in a predetermined direction over supporting terrain comprising a housing having a pair of sidewalls and an arcuate intervening wall and having an open bottom and a discharge opening through said arcuate wall, a rotary brush-type drum mounted within the housing and having bottom and front sides, for rotation about a generally horizontal axis in a direction from the bottom upwardly ahead of its front side and projecting through said open bottom and operative to dig into and comminute the soil therebeneath and discharge the same through the discharge opening, said housing having a ground-soil engaging lip ahead of said drum for guiding the soil from said drum over said lip.

15. The invention according to claim 14 and said intervening wall having an upwardly yieldable rear section with a lower end section adapted to ride along the ground for following the contour thereof.

16. The invention according to claim 14 in combination with a discharge duct connected to said housing for directing the comminuted soil onto a fire, and means for augmenting the throw of the soil by the drum comprising a blower for delivering a stream of air operative to entrain the soil as it discharges from said duct.

17. The invention according to claim 14 and said drum comprising a plurality of flexible digital members adapted to spring back attendant to digging into the soil and to spring forward upon withdrawal from the soil for flinging the soil through said discharge opening.

18. An aggregate throwing device for use in fire fighting movable over supporting terrain comprising a housing having a pair of sidewalls and an arcuate intervening wall and having an open bottom and a discharge opening through said arcuate wall, a rotary brush-type drum mounted within the housing for rotation about a generally horizontal axis and projecting through said open bottom, and operative to dig into and comminute the soil therebeneath and discharge the same through the discharge opening and, in combination with a discharge duct connected to said housing for directing the comminuted soil onto a fire, and means for augmenting the throw of the soil by the drum comprising a blower for delivering a stream of air operative to entrain the soil as it discharges from said duct, and said drum housing having an air inlet and said blower having a branch line extending in proximity to said air inlet and providing a zone of pressurized air directed at said inlet.

19. The invention according to claim 18 and a suction duct ahead of said drum and connected to said drum inlet.

* * * * *